United States Patent [19]

Sureau

[11] Patent Number: 4,864,321

[45] Date of Patent: Sep. 5, 1989

[54] ELECTROMAGNETIC ENERGY SHIELD

[75] Inventor: Jean-Claude Sureau, Boston, Mass.

[73] Assignee: Radant Technologies, Inc., Stow, Mass.

[21] Appl. No.: 642,076

[22] Filed: Aug. 20, 1984

[51] Int. Cl.[4] ..... H01Q 1/42

[52] U.S. Cl. ..... 343/872; 343/700 MS

[58] Field of Search ..... 343/700 MS, 18 A, 872, 343/873, 789, 781 P; 342/1, 2, 3, 4

[56] References Cited

U.S. PATENT DOCUMENTS 4,125,841 11/1978 Munk ..... 343/872

4,160,254 7/1979 Wise ..... 343/909

4,342,035 7/1982 Anderson et al. ..... 343/792.5

4,419,671 12/1983 Noerpel ..... 343/786

*Primary Examiner*—Theodore M. Blum

*Attorney, Agent, or Firm*—Robert F. O'Connell

[57] ABSTRACT

A structure for transmitting electromagnetic energy within a selected frequency range and preventing such transmission outside such range in which an insulative member has a metallized surface which includes an array of non-metallized regions each having the shape of a Jerusalem cross, the vertical and horizontal cross arms thereof having metallized regions along their length to form non-metallized gaps with the edges thereof.

10 Claims, 2 Drawing Sheets

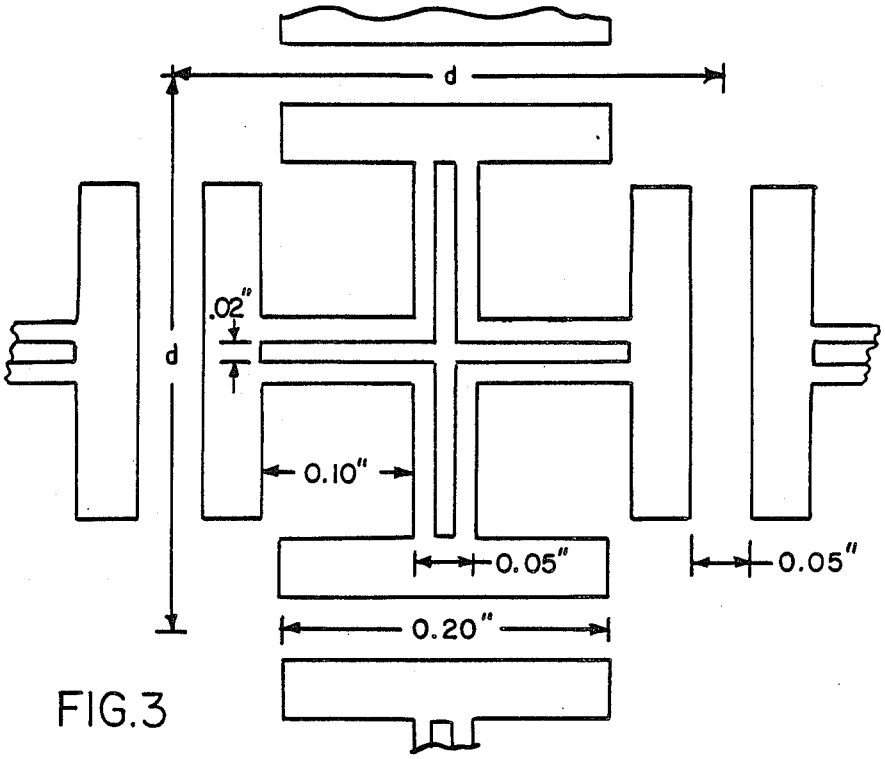
FIG.3
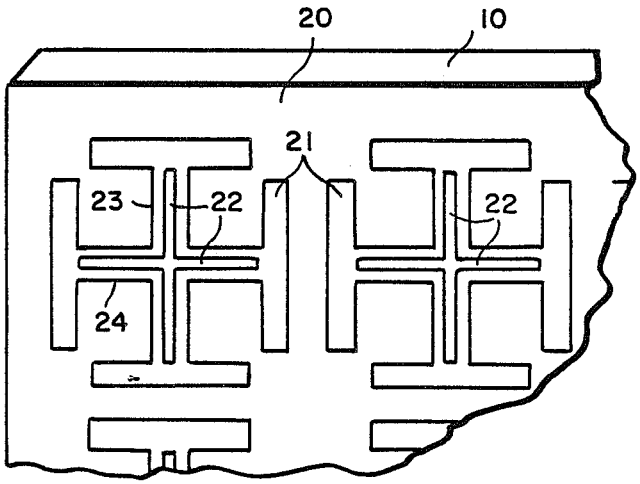
FIG.4
FIG.5
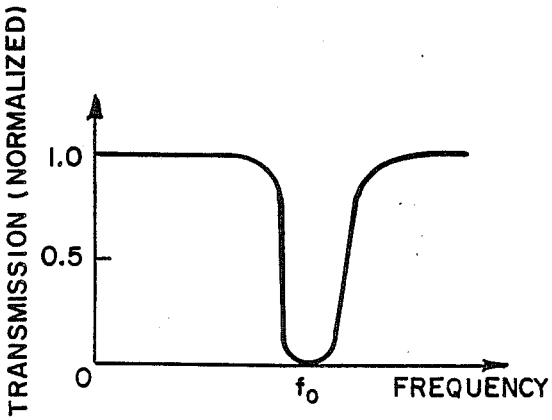

ELECTROMAGNETIC ENERGY SHIELD

INTRODUCTION

This invention relates generally to structures, such as radome structures, for permitting the transmission of electric energy therethrough and, more particularly, to a passive filter structure which permits the transmission of energy therethrough only over a selected frequency range.

BACKGROUND OF THE INVENTION

It is desirable in many applications to provide a structure, such as a radome structure, which will permit the transmission of energy in either direction therethrough only over a selected frequency range, or pass band of frequencies, and effectively to reject the transmission of energy at frequencies outside the pass band. In this way the radome structure will prevent the transmission of external signals through the structure to the equipment housed therein a frequencies outside the sometimes relatively narrow pass band of operation of such equipment so that the radome structure acts as an effective shield to such externally impinging electromagnetic energy.

DESCRIPTION OF THE PRIOR ART

Passive filter radomes, or other energy transmitting structures, have been fabricated in the past by utilizing so-called cruciform slot arrangements wherein the radome structure has a metallized surface which includes an array, or pattern, of non-metallized slots thereon, each in the form of a simple cross appropriately dimensioned to provide for the passive filtering operation involved. The use of such cross slots permits the surface to achieve its filtering operation independently of the polarization of the incident electromagnetic energy, at least at normal incidence to the surface.

It is desirable that the resonant frequency of the pass band remain substantially constant over as wide a range as possible of the incidence angle of the impinging electromagnetic energy for both planes of polarization (i.e., the E-plane, representing parallel polarized energy, and the H-plane, representing perpendicularly polarized energy). However, the traditional cruciform, or simple cross, slot configuration produces resonant frequency shifts which are quite significant, and undesirable, as the angle of incidence of the impinging energy changes off the normal.

In order to avoid such problem it has been suggested that the traditional cruciform configuration be modified so as to form a cross slot configuration which resembles a cross potent, sometimes referred to as a Jerusalem cross. The latter configuration tends to stabilize the resonant frequency so that it does not shift so significantly with a change in incidence angle of the impinging electromagnetic energy, at least over a more reasonable range of incidence angles. However, such a configuration tends to give rise to additional undesirable resonances at frequencies above the resonant frequency, particularly at frequencies close to one or more higher harmonics thereof (sometimes referred to as "harmonic-like" resonances), e.g. particularly at or near the second harmonic. In addition, both the conventional cross slot and the Jerusalem cross slot configurations both tend to give rise to back scatter problems, i.e., the production of undesired reflective lobes of energy in the reverse direction toward the direction of the impinging energy.

In order to overcome the problem of generating higher harmonic-like resonances, the standard cross slot configuration has been modified so as to provide conductive elements within the arms of the cross slots leaving relatively small gaps between such conductive elements and the edges of the cross arms. Such configuration has sometimes been referred to as a "loaded" cross configuration. While the harmonic-like resonances tend to be less of a problem with such a configuration, the back scatter problem is normally not improved at all and the secondary reflective lobes still tend to be present at one or more higher harmonic-like resonant frequencies.

BRIEF SUMMARY OF THE INVENTION

The invention utilizes a configuration which provides a substantially stable resonant frequency as a function of incidence angle, which tends to substantially lessen the harmonic-like resonant frequency content, and which further tends to reduce considerably the secondary reflective lobes so as to greatly improve the back scatter characteristics. In accordance with applicant's invention a periodic array of slots comprises slots having a cross potent, or Jerusalem cross, configuration wherein only the cross arm portions thereof contain metallized elements, the cross bars perpendicular to the ends of such arms not containing any metallized elements, a configuration which might be termed a "partially loaded" Jerusalem, or cross potent, configuration.

The use of such a partially loaded configuration permits the periodic array thereof to have reduced spacing between of the Jerusalem cross slot units in comparison with the spacing of the previously suggested configurations. Thus, in accordance with the invention the spacing can be arranged to be within less than $\lambda_0/3$, and normally between $\lambda_0/4$ to $\lambda_0/3$, where $\lambda_0$ is the wavelength at at the resonant frequency of the pass band of interest, while in the previous configurations such spacings were always required to be greater than $\lambda_0/3$ at the resonant frequency. It is found that the use of such reduced spacing considerably reduces the back scatter problem so that secondary reflective lobes become minimized.

DESCRIPTION OF THE INVENTION

The invention can be described in more detail with the help of the accompanying drawings wherein FIG. 1 depicts a portion of an embodiment of the invention;

FIG. 3 depicts a more detailed diagram of the dimensions of a portion of a practical embodiment of the invention of FIG. 1;

FIG. 4 depicts a portion of an alternative embodiment of the invention designed to provide a band reject operation; and FIG. 5 depicts a graph of the frequency characteristics of the embodiment of FIG. 4.

Figure 1:
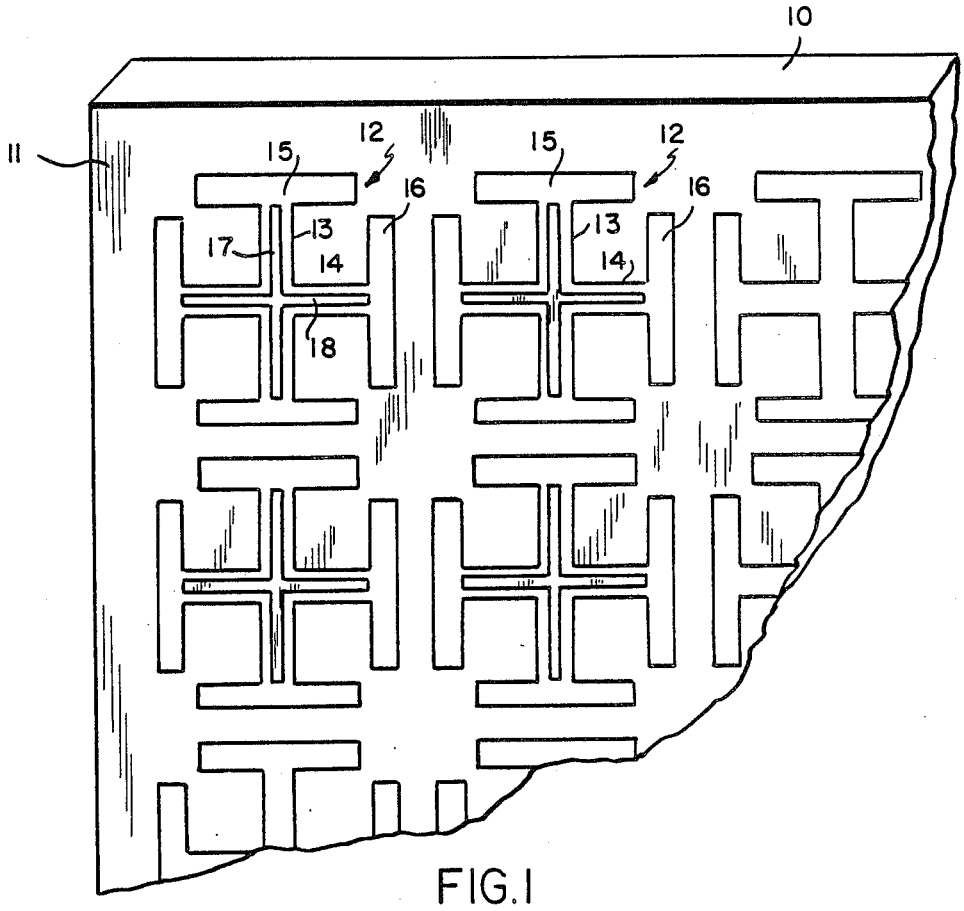

FIG. 1 depicts a portion of a passive filter panel in accordance with the invention wherein a substrate 10, comprised of a suitable insulative material, such as Teflon, utilizes a metallized surface 11 having a plurality of non-metallized slots 12 therein formed in a periodic array, i.e., periodic in both the horizontal and vertical direction, so as to provide a symmetrical array of such slot units. Each of the slot units 12 is depicted in FIG. 1 as comprising a cross slot configuration in the form of a cross potent, sometimes referred to as a Jerusalem cross, having vertical and horizontal cross arms 13 and 14, respectively, and flat perpendicular end bars 15 and 16, respectively, at each end thereof. In accordance with a preferred embodiment of the invention the cross arms 13 and 14 have metallized elements 17 and 18, respectively, positioned therein forming non-metallized gaps with the edges of said cross arms. No metallized elements are utilized in the flat end bar portions 15 and 16 and the metallized elements extend only to the junction of the cross arms 14, 15 and the end bars 15, 16, as shown.

Such a configuration has been found to permit the resonant frequency to be very low in comparison to the size of each slot unit. Typically it is possible to make the cell size unit and hence the spacing therebetween, as depicted by the dimension "d," between $\lambda_0/4$ and $\lambda_0/3$ at the resonant frequency $f_0$ of the desired pass band. Such distance as mentioned above compares with the normally required spacings for previously suggested slot configurations which are greater than $\lambda_0/3$ where $\lambda_0$ is the wavelength at the resonant frequency $f_0$.

Such spacing has been found to be crucial in the suppression of spurious transmission or reflection resonances, i.e. at harmonic-like resonant frequencies, particularly such as those close to the second harmonic or even higher harmonics. Moreover, it is found that the reduction in the spacing tends to reduce the amplitude of any spurious reflective side lobes (back scatter) which normally accompanies the previously suggested cross configurations.

Figure 2:
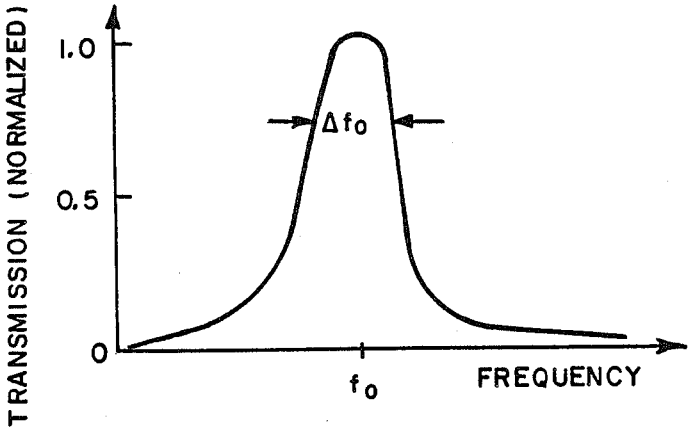
FIG. 2 depicts a graph of the frequency characteristics of the embodiment of FIG. 1.

FIG. 2 shows qualitatively a graph of a typical normalized transmission characteristic as a function of frequency of a passive filter constructed in accordance with the invention and having a center frequency $f_0$ and a bandwidth of $\Delta f_0$, as shown.

In a particular embodiment, for example, a periodic metallized surface was fabricated in accordance with the design of the invention by photo-etching the cross pattern on a 3 mil thick Teflon fiberglass substrate. The dimensions of the cross and the metallized elements are shown in more detail for a typical cross unit thereof at specified resonant frequency in FIG. 3. The lateral dimensions "d" of each of the cross units was set, for example, at 0.400 inches for a resonant frequency of 8.25 GigaHertz (GHz). As can be seen, such cross unit lateral dimension d is about 0.28 $\lambda_0$, where the resonant frequency $f_0$ is 8.25 GHz. Such a configuration provides a 3.0 dB band width of approximately 3.0 GHz. The resonant frequency remained stable at 8.25 GHz for incidence angles up to as high as 70° in both planes of polarization, the maximum loss at the same resonant frequency through the surface being approximately 0.5 dB. No significant resonance frequency at or near the second harmonic (or any other higher harmonic) was observed. Other dimensions for such specific embodiment are also shown in FIG. 3.

It is clear that different resonant frequencies can be achieved for different pass bands by appropriately scaling the above dimensions in accordance with normal design procedures which would be within the skill of those in the art. Exact dimensions often have to be finalized by empirical techniques, as would be well known in the art.

Different bandwidth percentages ,i.e., the resonance Q-factor, can be designed by modifying the dimensions of the gap between the metallized elements and the edges of the slot (i.e. the gap sizes between such elements and the slot). In general smaller gap sizes will tend to increase the Q and narrow the bandwidth while wider gaps will decrease the Q-factor and widen the bandwidth.

While the particular embodiments discussed above relate to the use of a passive bandpass filtering operation, the principles discussed therein can also be used in a complementary fashion to provide a passive "band reject" filtering operation, wherein all frequencies other than those within a specified frequency range are permitted to be transmitted in both directions therethrough, while only frequencies within such band are prevented from such transmission. A band reject filter panel can be fabricated as shown in FIG. 4 in which the metallized surfaces of the substrate 10 in the bandpass filter of the previous embodiment is replaced by using a non-metallized or insulative surface 20 and the slotted, or non-metallized, cross regions 12 of the previous structure are replaced by metallized regions 21. Thus, the metallized regions 21 are formed on the insulative surface of substrate 10 in the configuration of a cross potent, or Jerusalem cross, and non-metallized portions 22 are formed in the cross arm regions 23 and 24, as depicted, to form metallized gaps with the edges thereof. With an appropriate selection of the dimensions as discussed above, the configuration at FIG. 4 can provide a relatively narrow reject band as desired, and as shown qualitatively in the graph of FIG. 5

While the above embodiments illustrate the principles of operation of the invention and depict specific embodiments for achieving such operation, modifications thereto may occur to those skilled in the art within the spirit and scope of the invention. Hence the invention is not to be construed as limited to the particular embodiments discussed above except as defined by the appended claims.

What is claimed is:

1. A structure for transmitting electromagnetic energy within a selected frequency range and preventing the transmission of electromagnetic energy outside said frequency range, said structure comprising an insulative member having at least one metallized surface;

a plurality of non-metallized regions formed in a symmetrical array in said surface;

each of said non-metallized regions having the configuration of a Jerusalem cross comprising vertical and horizontal cross arms each having perpendicular bars at the ends thereof; and each of said vertical and horizontal cross arms having metallized regions therein.

2. An electromagnetic energy transmitting structure in accordance with claim 1 wherein said metallized regions extend along the lengths of said cross arms from the center of said cross configuration to said end bars so as to form non-metallized gaps with the edges of said cross arms.

3. An electromagnetic energy transmitting structure in accordance with claim 2 wherein the dimensions of said non-metallized gaps are selected to control the bandwidth and the Q-factor of said selected frequency range.

4. An electromagnetic energy transmitting structure in accordance with claim 2 wherein the dimensions of said non-metallized gaps are selected such that decreasing said gaps tends to decrease said bandwidth and to increase said Q-factor and increasing said gaps tends to increase said bandwidth and to decrease said Q-factor.

5. An energy transmitting structure in accordance with claim 1 wherein the lateral dimensions of said cross configurations plus one half the distance between said cross configurations and the cross configurations adjacent thereto form a substantially square corss unit configuration.

6. An electromagnetic energy transmitting structure in accordance with claim 5 wherein the lateral dimensions of each of said cross unit configurations is between $\lambda_0/4$ and $\lambda_0/3$, where $\lambda_0$ is the wave length at the resonant frequency of said selected frequency range.

7. An electromagnetic energy transmitting structure for preventing the transmission of electromagnetic energy within a selected frequency range and for transmitting electromagnetic energy outside said frequency range, said structure comprising an insulative member having a plurality of metallized regions formed in a symmetrical array on a surface thereof, each of said metallized regions having the configuration of a Jerusalem cross comprising vetical and horizontal cross arms and having perpendicular bars at the ends thereof, and each of said metallized cross arms having non-metallized regions therein.

8. An electromagnetic energy transmitting structure in accordance with claim 7 wherein said non-metallized regions extend along the lengths of said cross arms from the center of said cross configuration to said end bars so as to form metallized gaps with the edges of said cross arms.

9. An electromagnetic energy transmitting structure in accordance with claim 8 wherein the dimensions of said metallized gaps are selected to control the bandwidth and the Q-factor of said selected frequency range.

10. An electromagnetic energy transmitting structure in accordance with claim 9 wherein the dimensions of said metallized gaps are selected such that decreasing said gaps tends to decrease said bandwidth and to increase said Q-factor and increasing said gaps tends to increase said bandwidth and to decrease said Q-factor.

* * * * *